US006227874B1

(12) United States Patent
Yu

(10) Patent No.: US 6,227,874 B1
(45) Date of Patent: May 8, 2001

(54) ELECTRONIC CARD CONNECTION SYSTEM

(75) Inventor: Hung-Chi Yu, Hsi-Chih (TW)

(73) Assignee: Hon Hai Aprecision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/347,950

(22) Filed: Jul. 6, 1999

(30) Foreign Application Priority Data

Dec. 28, 1998 (TW) ..... 87221639

(51) Int. Cl.[7] ..... H01R 12/00
(52) U.S. Cl. ..... 439/79; 439/64
(58) Field of Search ..... 439/377, 79, 64, 439/80, 607, 660

(56) References Cited

U.S. PATENT DOCUMENTS 4,869,677 * 9/1989 Johnson et al. ..... 439/80
5,636,999 * 6/1997 Hirai et al. ..... 439/79
5,688,130 * 11/1997 Huang ..... 439/79
5,915,976 * 6/1999 McHugh ..... 439/74
6,116,920 * 9/2000 Yu et al. ..... 439/79

* cited by examiner

*Primary Examiner*—Brian Sircus
*Assistant Examiner*—Michael C. Zarroli
(74) *Attorney, Agent, or Firm*—Wei Te Chung

(57) ABSTRACT

An electronic card connection system includes a connector adapted to engage with an electronic card and a mounting member fixed on a circuit board. The connector retains two rows of first contacts therein with a tail section of each first contact extending beyond the connector. A spacer is attached to the connector and defines a chamber bound by two side walls. A number of holes are defined in the spacer in communication with the chamber for extension of the tail sections of the first contacts into the chamber. The tail sections are supported by inner surfaces of the side walls. The mounting member defines two slots for receiving the side walls of the spacer. Each slot has second contacts arranged therein for engaging with the tail sections of the first contacts. A shielding member is attached to the connector and has grounding pins received in the chamber of the spacer and alternately arranged with the tail sections. The grounding pins are also engaged with the second contacts of the mounting member with the second contacts that engage with the grounding pins being connected to grounding paths of the circuit board.

8 Claims, 4 Drawing Sheets

ELECTRONIC CARD CONNECTION SYSTEM

BACKGROUND OF THE INVENTION

1. Field of the Invention

The present invention generally relates to an electronic card connector, and in particular to a structure of an electronic card connector that eliminates undesired deformation of contacts thereof when mounting the connector to a circuit board.

2. The Prior Art

As high-density electrical devices become increasing popular, pitch between contacts of electrical connectors is getting smaller whereby the contacts are positioned very close to each other. However, if the contacts become deformed a short circuit may be formed between adjacent contacts when mounting the connector on a circuit board. Electronic card connectors, such as those disclosed in U.S. Pat. Nos. 5,290,174 and 5,297,966 and Taiwan Patent Application No. 84101873, comprise contacts having tail sections that are not well supported and protected from undesired deformation when mounting the connector to a circuit board.

FIG. 4 shows a conventional electronic card connector 100. The electronic card connector 100 comprises an insulative header 10 retaining a plurality of contacts 11 therein. The contacts 11 have L-shaped tail sections 110 for insertion into apertures 14 defined in a circuit board 13 to be soldered thereto. The tail sections 110 are only supported by a spacer plate 12 and thus have a substantial unsupported portion whereby when the tail sections 110 are inserted into the apertures 14 of the circuit board 13, the unsupported portions of the tail sections 110 may become deformed leading to improper signal transmission.

Furthermore, the electronic card connector 100 is provided with a shielding member (not shown) attached thereto for shielding the contacts 11 from electromagnetic interference. The shielding member has grounding pins separately connected to the circuit board, which complicates manufacture of the electronic card connector 100.

It is thus desirable to have an electronic card connector that eliminates the problems mentioned above.

SUMMARY OF THE INVENTION

Accordingly, an object of the present invention is to provide an electronic card connector having contacts supported and protected from undesired deformation when mounting the electronic card connector to a circuit board.

Another object of the present invention is to provide an electronic card connection system comprising a connector releasably mounted to a mounting member fixed on a circuit board, contacts and grounding pins of the connector being electrically connected to the circuit board by secondary contacts arranged in the mounting member thereby eliminating the requirement of separately mounting the grounding pins to the circuit board.

A further object of the present invention is to provide an electronic card connector comprising contacts which are protected from the adverse affects of external forces.

To achieve the above objects, an electronic card connection system in accordance with the present invention comprises a connector adapted to engage with an electronic card and a mounting member fixed on a circuit board. The connector retains two rows of first contacts therein with a tail section of each first contact extending beyond the connector. A spacer is attached to the connector and defines a chamber bound by two side walls. A number of holes are defined in the spacer in communication with the chamber for extension of the tail sections of the first contacts into the chamber. The tail sections are supported by inner surfaces of the side walls. The mounting member defines two slots for receiving the side walls of the spacer. Each slot has second contacts arranged therein for engaging with the tail sections of the first contacts. A shielding member is attached to the connector and has grounding pins received in the chamber of the spacer and alternately arranged with the tail sections. The grounding pins are also engaged with the second contacts of the mounting member with the second contacts that engage with the grounding pins being connected to grounding paths of the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
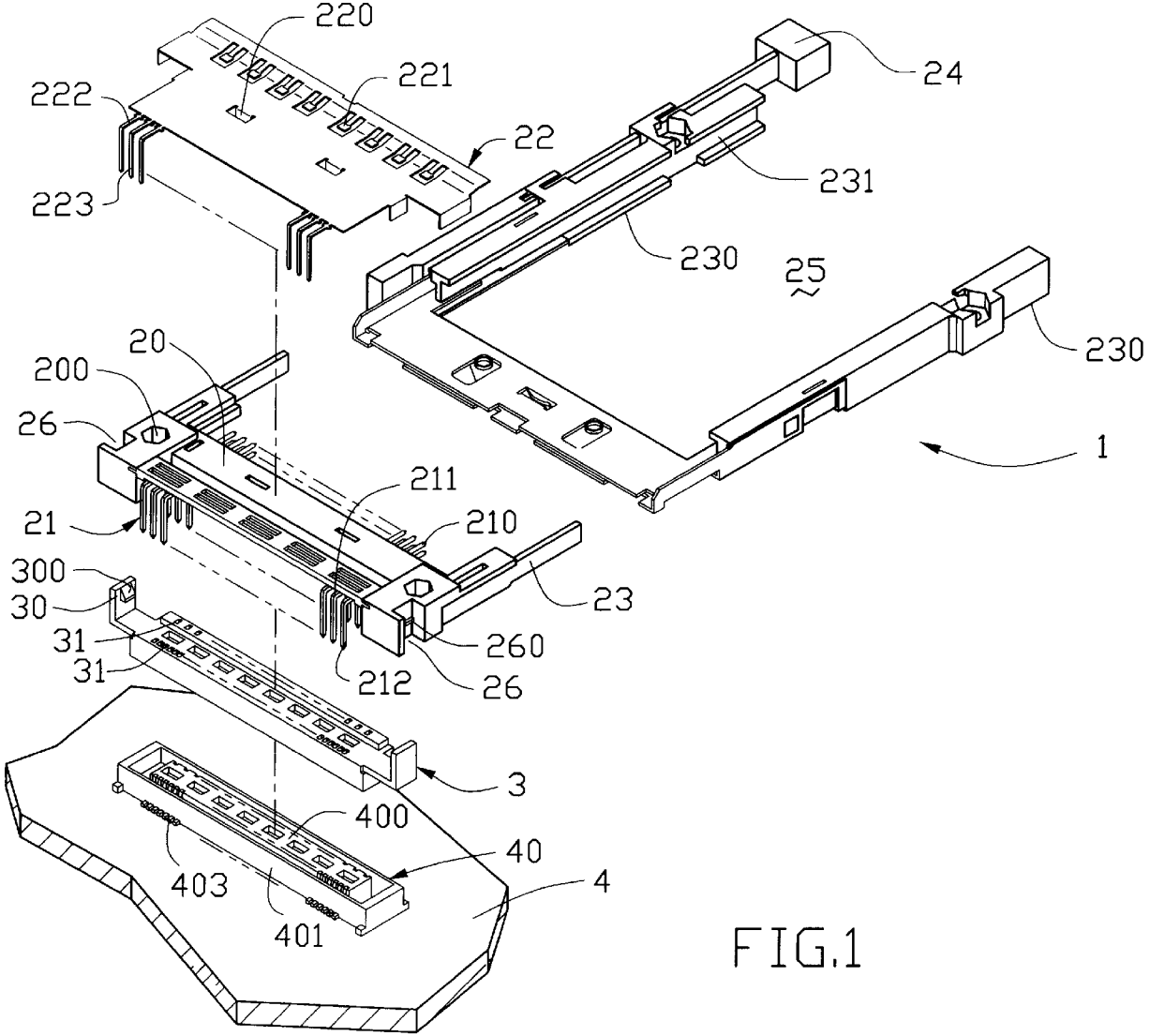
FIG. 1 is an exploded view of an electronic card connection system constructed in accordance with the present invention.

Referring to the drawings and in particular to FIG. 1, an electronic card connection system in accordance with the present invention comprises a connector 1 for engaging with an electronic card (not shown) and a mounting member 40 fixed on a circuit board 4 and engageable with the connector 1 for connecting the connector 1 to the circuit board 4.

The connector 1 comprises an insulative header 2 having a contact retaining section 20 retaining a plurality of first contacts 21 therein in two rows. A shielding member 22 is attached to and shields an upper surface of the header 2. Through holes 200 are defined in the header 2 proximate opposite ends of the contact retaining section 20 for receiving bolts (not shown) to secure the connector 1 to the circuit board 4.

The header 2 has two parallel support sections 23 extending from the opposite ends thereof. A guide arm 230 is fixed to and supported by each of the support sections 23 whereby a card receiving space 25 is defined between the guide arms 230 for receiving the electronic card. Each guide arm 230 defines a guide channel 231 for guiding the electronic card into the card receiving space 25 to engage with the header 2. A card release mechanism 24 is mounted to one of the support arms 230 for ejecting the electronic card from the header 2.

The shielding member 22 comprises retaining projections 220 mechanically engaging with the header 2 for fixing the shielding member 22 thereto. Card grounding tabs 221 and board grounding pins 222 are formed on the shielding member 22 for respectively engaging with the electronic card and contacting the circuit board 4 for grounding purposes. The board grounding pins 222 have L-shaped tail extensions 223.

Figure 2:
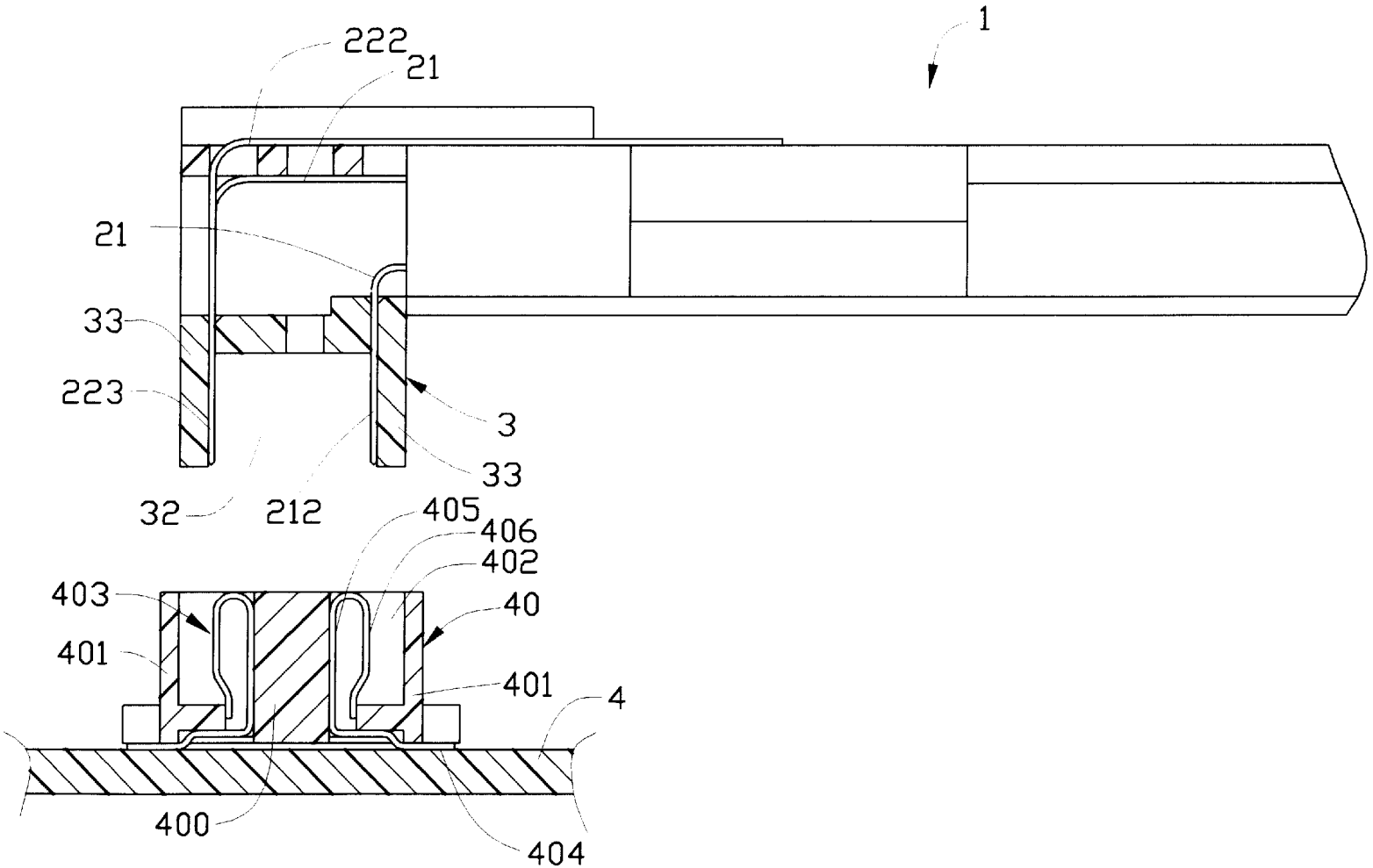
FIG. 2 is a cross-sectional view of the assembled electronic card connection system with a connector thereof detached from a mounting member fixed on a circuit board.

Also referring to FIG. 2, each first contact 21 is retained in the header 2 with a front section 210 extending beyond a first face of the header 2 for electrically engaging with the electronic card and a rear section 211 extending beyond an opposite second face of the header 2 and having an L-shaped tail section 212. The tail sections 212 of the first contacts 21 are arranged in two rows with the tail extensions 223 of the board grounding pins 222 being alternately arranged with the tail sections 212 of one row of the first contacts 21.

A spacer 3 defines first and second rows of holes 31 in a top face thereof for extension of the tail sections 212 of the first contacts 21 and the tail extensions 223 of the shielding member 22 therethrough. The spacer 3 forms two resilient arms 30 at opposite ends thereof for being received in recesses 26 defined in the header 2. Each resilient arm 30 forms a barb 300 for engaging with a projection 260 formed in the corresponding recess 26 for fixing the spacer 3 to the header 2.

Figure 3:
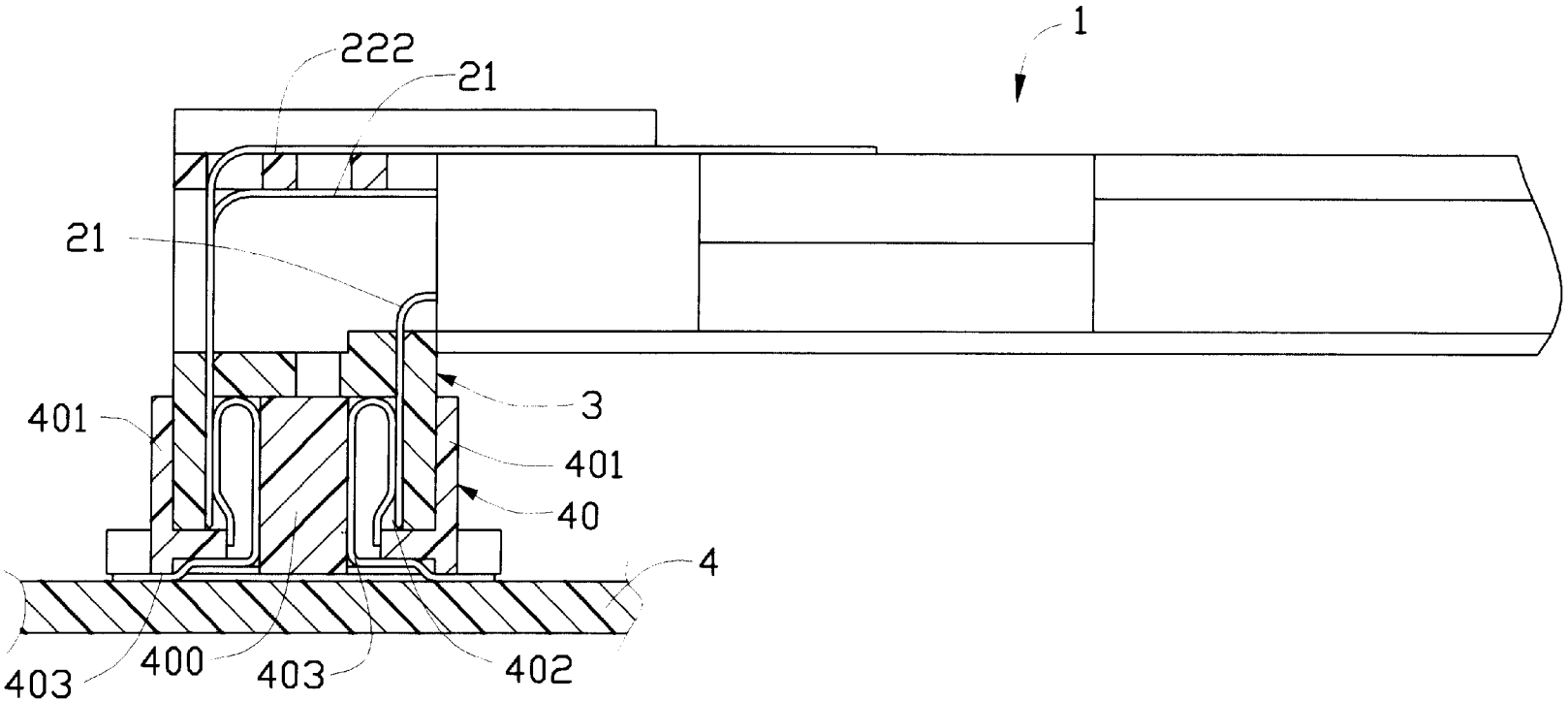
FIG. 3 is similar to FIG. 2 with the connector thereof attached to the mounting member.
Figure 4:
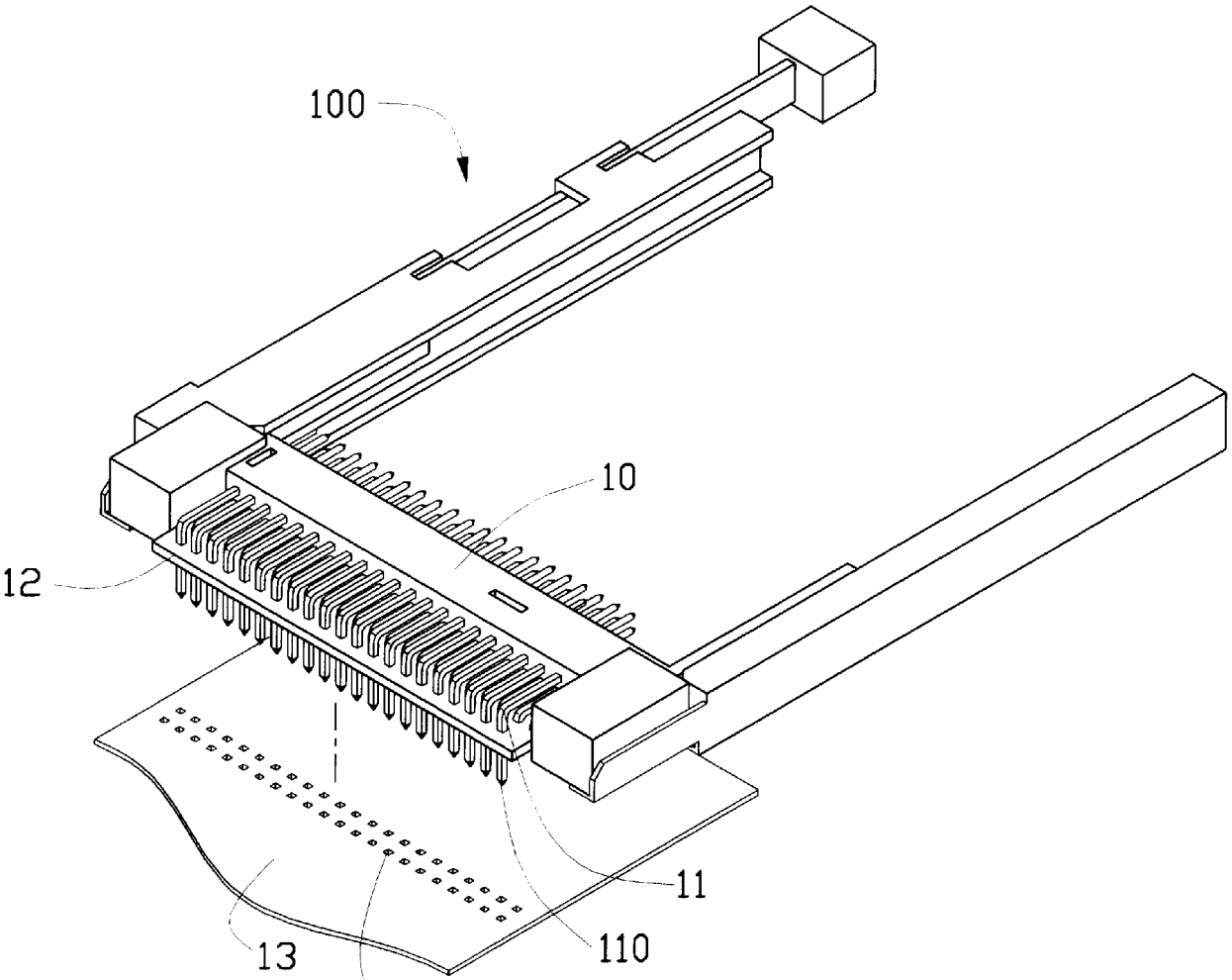
FIG.4 PRIOR ART
FIG. 4 is a perspective view of a conventional electronic card connector.

Referring to FIGS. 2 and 3, the spacer 3 further defines a chamber 32 in a bottom face thereof in communication with the holes 31. The chamber 32 is bound by two side walls 33 and the two rows of holes 31 are arranged to be substantially aligned with inner surfaces of the corresponding side walls 33 whereby the tail sections 212 of the first contacts 21 and the tail extensions 223 of the shielding member 22 abut against and are thus entirely supported by the inner surfaces of the side walls 33. If desired, grooves (not shown) may be formed in the inner surfaces of the side walls 33 for receiving and more securely supporting the tail sections 212 of the first contacts 21 and the tail extensions 223 of the shielding member 22.

The mounting member 40 comprises two side walls 401 and an internal wall 400 located between and spaced from the side walls 401 thereby defining two slots 402 exposed to a top surface of mounting member 40. A plurality of second contacts 403 is received and retained in each slot 402. Each second contact 403 has a tail section 404 extending beyond a bottom surface of the mounting member 40 for electrically engaging with the circuit board 4 and a mating section 405 abutting against a surface of the internal wall 400 to be supported thereby. If desired, as shown in FIG. 1, grooves (not labeled) may be formed in the surface of the internal wall 400 for receiving and more securely supporting the mating sections 405 of the second contacts 403.

The mounting member 40 is dimensioned to receive the side walls 33 of the spacer 3 therein with the internal wall 400 and the mating sections 405 of the second contacts 403 fit into the chamber 32 of the spacer 3. Interferential engagement is established between the side walls 33 of the spacer 3 and the side walls 401 of the mounting member 40 thereby retaining the connector 1 on the mounting member 40.

When the connector 1 is mounted to the mounting member 40, the surfaces of the internal wall 400 of the mounting member 40 confront the inner surfaces of the side walls 33 of the spacer 3 whereby the mating sections 405 of the second contacts 403 engage with the tail sections 212 of the first contacts 21 and the tail extensions 223 of the shielding member 22. Preferably, the mating sections 405 are provided with resilient fingers 406 for ensuring proper engagement between the second contacts 403 and the first contacts 21 and the board grounding pins 222.

When mounting the connector 1 to the mounting member 40, the tail sections 221 of the first contacts 21 and the tail extensions 223 of the shielding member 22 are supported by the inner surfaces of the side walls 33 of the spacer 3 whereby undesired deformation of the tail sections 221 of the first contacts 21 and the tail extensions 223 of the shielding member 22 is eliminated. The second contacts 403 that are engaged with the board grounding pins 222 are connected to grounding paths of the circuit board 4 thereby grounding the shielding member 22.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electronic card connection system comprising:

a connector adapted to engage with an electronic card and retaining at least a first row of first contacts, each first contact extending beyond a face of the connector and forming an L-shaped tail section;

a spacer attached to the connector and defining a plurality of holes in a top face thereof and a chamber in a bottom face thereof, the chamber being in communication with the holes wherein the tail sections of the first contacts extend into the chamber through the corresponding holes and are entirely supported by an inner surface of a first side wall of the chamber;

a mounting member adapted to be fixed on a circuit board and electrically connected thereto, the mounting member defining a first slot corresponding to and receiving the first side wall of the spacer therein, a plurality of second contacts being arranged in the first slot for electrically engaging with the tail sections of the first contacts to establish electrical engagement therebetween; and a shielding member attached to the connector and comprising grounding pins extending into the chamber of the spacer through the holes thereof and being alternately arranged with the tail sections of the first row of first contacts, wherein the second contacts of the mounting member engage with both the grounding pins of the shielding member and the tail sections of the first contacts, the second contacts engaged with the grounding pins being connected to grounding paths of the circuit board.

2. An electronic card connection system comprising:

a connector adapted to engage with an electronic card and retaining two rows of first contacts therein, each first contact extending beyond a face of the connector and forming an L-shaped tail section;

a spacer attached to the connector and defining a plurality of holes in a top face and a chamber in a bottom face thereof, the chamber being bound by two spaced side walls and in communication with the holes, tail sections of the contacts being inserted into the chamber through the corresponding holes and entirely supported by inner surfaces of the side walls; and a mounting member adapted to be fixed on a circuit board and electrically connected thereto, the mounting member defining two slots separated by an internal wall, the slots corresponding to and receiving the side walls of the spacer therein, a plurality of second contacts being arranged in the slots and supported by surfaces of the internal wall for engaging with the tail sections of the first contacts to establish electrical engagement therebetween;

wherein the spacer has two resilient barbs engaging with projections formed on the connector for attaching the spacer to the connector.

3. The electronic card connection system as claimed in claim 2 further comprising a shielding member attached to the connector, the shielding member comprising grounding pins extending into the chamber of the spacer through the holes thereof and being alternately arranged with the tail sections of one row of the first contacts, wherein the second contacts of the mounting member engage with both the grounding pins of the shielding member and the tail sections of the first contacts, the second contacts engaged with the grounding pins being connected to grounding paths of the circuit board.

4. The electronic card connection system as claimed in claim 3, wherein each second contact comprises a resilient finger engaging with the corresponding first contact.

5. The electronic card connection system as claimed in claim 3, wherein each second contact comprises a resilient finger engaging with the corresponding grounding pin.

6. An electronic card connection system comprising:

a connector adapted to engage with an electronic card and retaining at least a first row of first contacts, each first contact extending beyond a face of the connector and forming an L-shaped tail section;

a spacer attached to the connector and defining a plurality of holes in a top face thereof and a chamber in a bottom face thereof, the chamber being in communication with the holes whereby the tail sections of the first contacts extend into the chamber through corresponding holes;

a shielding member attached to the connector, said shielding member comprising grounding pins, the grounding pins being alternately arranged with the tail sections of the first row of first contacts and extending through corresponding holes and into the chamber; and a mounting member adapted to be fixed on a circuit board and electrically connected thereto, the mounting member defining a slot receiving the tail sections of the first contacts therein, a plurality of second contacts being arranged in the first slot for electrically engaging with both the tail sections of the first contacts and the grounding pins to establish electrical engagement therebetween.

7. An electronic card connection system comprising:

a connector adapted to engage with an electronic card and retaining at least a first row of first contacts, each first contact extending beyond a face of the connector and forming an L-shaped tail section;

a spacer attached to the connector and defining a plurality of holes in a top face and a chamber in a bottom face thereof, the chamber being in communication with the holes wherein the tail sections of the first contacts extend into the chamber through the corresponding holes and are entirely supported by an inner surface of a first side wall of the chamber; and a mounting member adapted to be fixed on a circuit board and electrically connected thereto, the mounting member defining a first slot corresponding to and receiving the first side wall of the spacer therein, a plurality of second contacts being arranged in the first slot for electrically engaging with the tail sections of the first contacts to establish electrical engagement therebetween;

wherein the connector retains a second row of first contacts having tail sections extending beyond the face of the connector and received in the chamber of the spacer and supported by an inner surface of a second side wall of the spacer, and wherein the mounting member defines a second slot for receiving the second side wall of the spacer, second contacts being arranged in the second slot for electrically engaging with the tail sections of the second row of first contacts.

8. An electronic card connection system as claimed in claim 7 further comprising a shielding member attached to the connector, the shielding member comprising grounding pins extending into the chamber of the spacer through the holes thereof and being alternately arranged with the tail sections of the first row of the first contacts, wherein the second contacts of the mounting member engage with both the grounding pins of the shielding member and the tail sections of the first contacts, the second contacts engaged with the grounding pins being connected to grounding paths of the circuit board.

* * * * *